United States Patent [19]

Jeschke et al.

[11] Patent Number: 5,020,433

[45] Date of Patent: Jun. 4, 1991

[54] DEVICE FOR CLEANING A PLATE CYLINDER AND/OR A BLANKET CYLINDER OF AN OFFSET PRINTING MACHINE, AND METHOD OF OPERATING THE DEVICE

[75] Inventors: Willi Jeschke, Bad Herrenalb; Anton Rodi, Leimen, both of Fed. Rep. of Germany

[73] Assignee: Heidelberger Druckmaschinen AG, Heidelberg, Fed. Rep. of Germany

[21] Appl. No.: 381,129

[22] Filed: Jul. 17, 1989

[30] Foreign Application Priority Data

Jul. 16, 1988 [DE] Fed. Rep. of Germany ..... 3824236

[51] Int. Cl.[5] ..... B41F 35/00

[52] U.S. Cl. ..... 101/425; 101/423

[58] Field of Search ..... 101/425, 423, 424, 424.1, 101/424.2; 15/256.5, 256.51, 256.52, 256.53

[56] References Cited

U.S. PATENT DOCUMENTS

| | | | |
|---|---|---|---|
| 2,898,855 | 8/1959 | Richter | 101/425 |
| 3,194,156 | 7/1965 | Picking | 101/425 |
| 3,520,410 | 7/1970 | Hutto | 101/425 |
| 3,785,289 | 1/1974 | Davidson | 101/425 |

FOREIGN PATENT DOCUMENTS

| | | | |
|---|---|---|---|
| 1960728 | 8/1965 | Fed. Rep. of Germany . | |
| 3410376 | 9/1984 | Fed. Rep. of Germany | 101/425 |
| 2759 | 8/1982 | Japan | 101/425 |
| 8600893 | 4/1986 | PCT Int'l Appl. | 101/425 |
| 8706528 | 4/1987 | PCT Int'l Appl. | 101/425 |

OTHER PUBLICATIONS

Web Press Engineering, "Automatic Blanket Washer".

*Primary Examiner*—Edgar S. Burr
*Assistant Examiner*—Joseph R. Keating
*Attorney, Agent, or Firm*—Herbert L. Lerner; Laurence A. Greenberg

[57] ABSTRACT

Device for cleaning at least one of a plate and a blanket cylinder of an offset printing machine, includes a plurality of cleaning elements disposed adjacent one another in a direction parallel to a cylindrical peripheral surface of at least one of a plate and a blanket cylinder; a driving device for positioning each of the cleaning elements towards and away from the at least one cylinder; and an input and control device for actuating a respective cleaning element; and method of operating the device.

11 Claims, 2 Drawing Sheets

Figure 3:
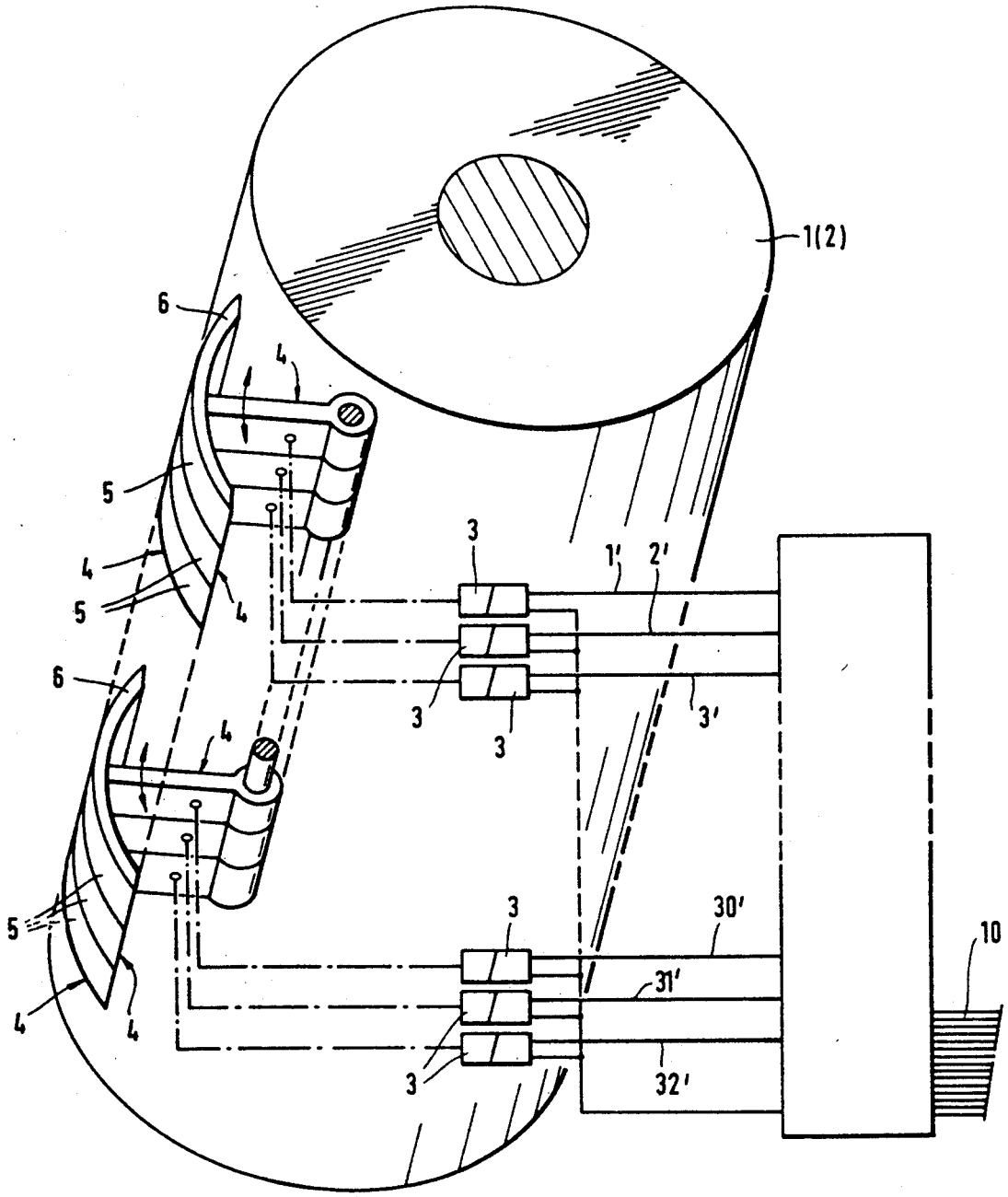

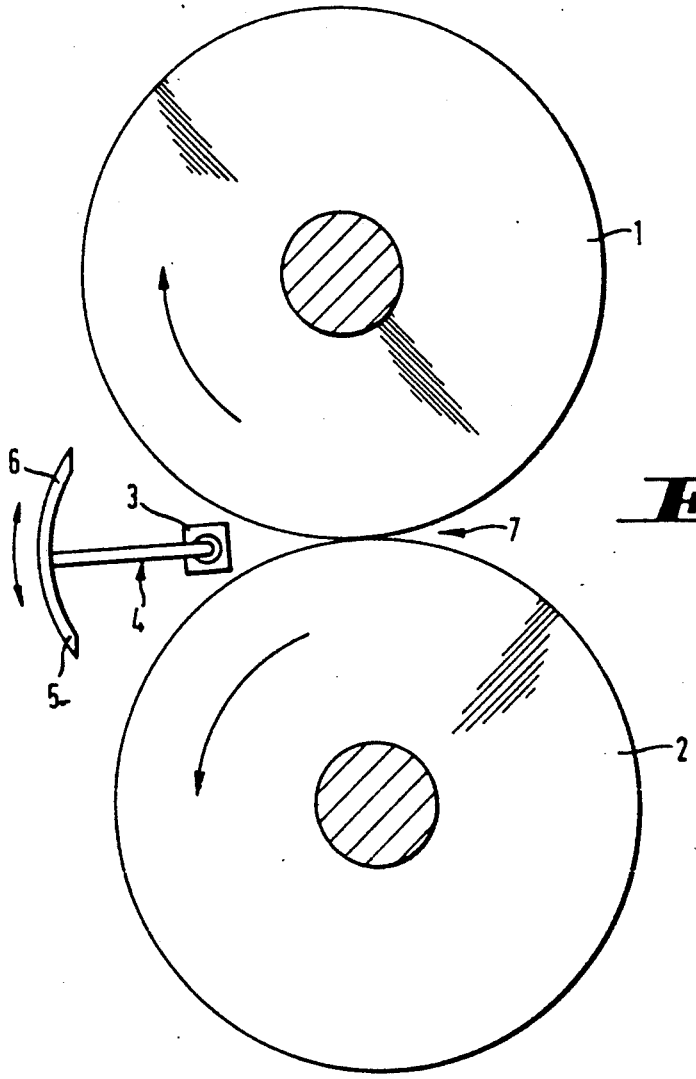
Fig. 1
Fig. 2a
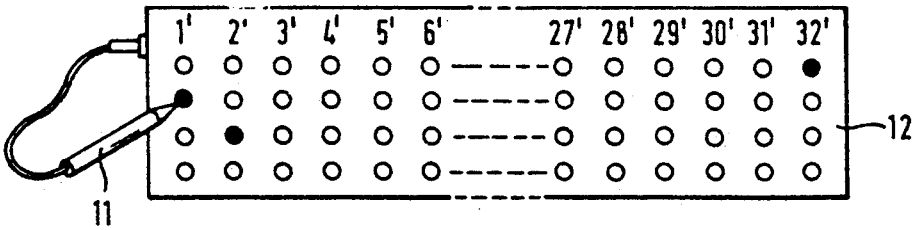
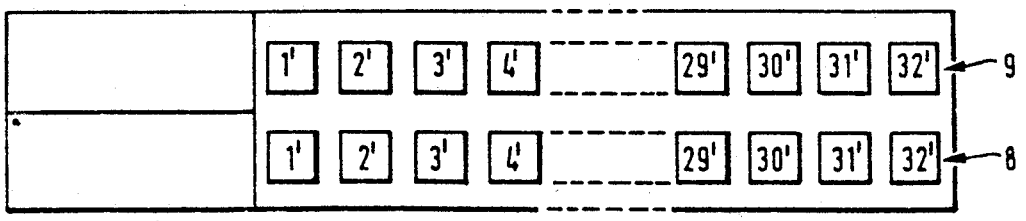
Fig. 2b

DEVICE FOR CLEANING A PLATE CYLINDER AND/OR A BLANKET CYLINDER OF AN OFFSET PRINTING MACHINE, AND METHOD OF OPERATING THE DEVICE

The invention relates to a device for cleaning a plate cylinder and/or a blanket cylinder of an offset printing machine, and a method of operating the device.

In offset printing machines, the printing plate is mounted on a cylinder, the so-called plate cylinder. Printing ink is applied to this plate cylinder by pressing the ink applicator or form roller against it. The ink adhering to the plate cylinder is then transferred to a further cylinder which has an outer cylindrical surface covered by a blanket. The cylinder provided with the blanket is the so-called blanket cylinder. An impression cylinder is located opposite the blanket cylinder and it has the function to press against the blanket cylinder a paper sheet which is to be printed with ink and which is running into the printing unit. Ink transport occurs accordingly from the ink roller via the plate cylinder to the blanket cylinder A trouble-free image requires amongst other things that, during the aforementioned ink transport, optimal conditions with respect to the cleanliness of ink, plate cylinder and blanket cylinder exist. When dust, dirt or ink residues, and the like, are present on the plate cylinder and/or blanket cylinder, trouble-free transfer of the printing ink from the plate cylinder to the blanket cylinder and from the blanket cylinder to the sheet to be printed, respectively, is not assured.

A transfer of printing ink which is not free of trouble results in stains or spots on the sheet being printed When such stains or spots occur, immediate measures must be taken in order to limit the then inevitably occurring spoilage or waste.

A measure which may be taken is to shut off the machine and to then clean the plate cylinder and/or the blanket cylinder manually. This method is time-intensive, however, and decisively reduces productivity.

In order to minimize productivity losses, the machine personnel (the printer) often ignores the manual removal of the impurities during machine operation as much as possible. This is a very dangerous method which can cause accidents and damage to the machine if the cleaning device, for example, is drawn or pulled into the machine. In addition thereto, in a production run which is not interrupted for cleaning purposes, a great amount of spoilage or waste is produced.

In order to avoid manual intervention for cleaning purposes, devices have become known in the state of the art by means of which impurities may be removed mechanically or by machine.

German Published Non-Prosecuted Application (DE-OS) 34 10 376 discloses, for example, a device for cleaning a plate cylinder. The device has a traverse extending parallel to the plate cylinder and serving simultaneously as a guide rail for the cleaning device per se. The cleaning device is positioned opposite the impurity by means of the guide rail.

In a further phase of operation, the cleaning device is moved towards the plate cylinder until it reaches the surface of the plate, and the impurity present at this location is removed by the cleaning device.

When an impurity occurs at another location, the cleaning device must be shifted and positioned again parallel to the plate cylinder on the guide rail. This type of cleaning has a disadvantage in that, respectively, before the cleaning operation, a positioning run must be performed which is time-consuming, especially if impurities occur simultaneously at several locations on the plate cylinder or if the impurities which occur are over a large area. When very high printing speeds in general exist, a great occurrence of spoilage or waste results therefrom.

It is accordingly an object of the invention to provide a device for cleaning a plate cylinder and/or a blanket cylinder of an offset printing machine, as well as a method of operating the device, by which a relatively rapid and reliable removal of impurities on the plate cylinder and/or the blanket cylinder by remote control during the printing operation is assured.

With the foregoing and other objects in view, there is provided, in accordance with the invention, a device for cleaning at least one of a plate and a blanket cylinder of an offset printing machine, comprising a plurality of cleaning elements disposed adjacent one another in a direction parallel to a cylindrical peripheral surface of at least one of a plate and a blanket cylinder; a driving device for positioning each of the cleaning elements towards and away from the at least one cylinder; and an input and control device for actuating a respective cleaning element.

In accordance with another feature of the invention, there is provided, a rotary magnet to which each of the cleaning elements is attached, each of the cleaning elements being displaceable along a circular path towards the cylindrical peripheral surface of the at least one cylinder.

In accordance with a further feature of the invention, each of the cleaning elements is formed as a slider, the slider being displaceable towards and away from the at least one cylinder.

In accordance with an added feature of the invention, there is provided a motor operatively connected to each of the cleaning elements for actuating the cleaning elements.

In accordance with an additional feature of the invention, the motor is a transmission motor.

In accordance with yet another feature of the invention, the input and control device includes means for adjusting ink zones of an inking device having a keyboard by which the cleaning elements are actuatable.

In accordance with yet further feature of the invention, the input and control device includes means for adjusting ink zones for an inking device having a light pen by which the cleaning elements are actuatable. In accordance with another aspect of the invention, there is provided a method of operating a device for cleaning at least one of a plate and a blanket cylinder of an offset printing machine having a plurality of cleaning elements disposed adjacent one another in a direction parallel to a cylindrical peripheral surface of at least one of a plate and a blanket cylinder, a driving device for positioning each of the cleaning elements towards and away from the at least one cylinder, and an input and control device for actuating a respective cleaning element, the input and control device including means for adjusting ink zones of an inking device having a keyboard by which the cleaning elements are actuatable, which comprises depressing at least one of the keys of the keyboard for a period of time corresponding to the time period during which cleaning is effected by the cleaning device.

In accordance with a further aspect of the invention, there is provided a method of operating a device for cleaning at least one of a plate and a blanket cylinder of an offset printing machine having a plurality of cleaning elements disposed adjacent one another in a direction parallel to a cylindrical peripheral surface of at least one of a plate and a blanket cylinder, a driving device for positioning each of the cleaning elements towards and away from the at least one cylinder, and an input and control device for actuating a respective cleaning element, the input and control device including means for receiving preset time limiting data, which comprises actuating the cleaning elements to perform a cleaning operation within the preset time limit.

In accordance with an additional aspect of the invention, there is provided a method of operating a device for cleaning at least one of a plate and a blanket cylinder of an offset printing machine having a plurality of cleaning elements disposed adjacent one another in a direction parallel to a cylindrical peripheral surface of at least one of a plate and a blanket cylinder, a driving device for positioning each of the cleaning elements towards and away from the at least one cylinder, and an input and control device for actuating a respective cleaning element, the input and control device including means for adjusting ink zones of an inking device having a light pen by which the cleaning elements are actuatable, which comprises inputting values with the light pen for establishing the cleaning time of a cleaning operation by the cleaning device.

An advantage of the aforedescribed invention is that, during the printing operation, a cleaning operation which is to be performed by remote control can be effected, wherein cleaning can take place simultaneously at several locations along the plate and/or the blanket cylinder.

Other features which are considered as characteristic for the invention are set forth in the appended claims.

Although the invention is illustrated and described herein as embodied in device for cleaning a plate cylinder and/or a blanket cylinder of an offset printing machine, and method for operating the same, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

FIG. 1 is a diagrammatic side elevational view of a blanket and a plate cylinder with a cleaning device according to the invention located behind the printing gap as viewed in the direction of rotation of the cylinders;

FIG. *2a* is a front elevational view of an ink zone display including a light pencil;

FIG. *2b* is a top plan view of a keyboard for selecting respective functions; and FIG. 3 is a partly schematic and diagrammatic perspective view of the device of the invention as applied to one of the cylinders and showing several cleaning elements disposed adjacent one another.

Referring now to the figures of the drawings in detail and first, particularly, to FIG. 1 thereof, there is shown therein a plate cylinder 1, adjacent to a blanket cylinder 2, a rotary magnet 3 and a cleaning element 4 forming part of the invention. The rotary magnet 3 is located behind the mutually adjacent plate cylinder 1 and blanket cylinder 2, as viewed in the rotary direction of those cylinders, and at a level with a printing gap 7 located between the cylinders 1 and 2. The cleaning element 4 is firmly connected to the rotary magnet 3 and is provided with two ink doctor blades 5 and 6, the ink doctor blade 5 being directed towards the blanket cylinder 2, and the ink doctor blade 6 being directed towards the plate cylinder 1.

As shown in FIG. 3, the plate cylinder 1 (and the blanket cylinder 2, respectively) is included with the embodiment of the invention. The rotary magnet is firmly connected to the cleaning element 4 so that the cleaning element 4 can follow the movements of the rotary magnet 3. The rotary magnet 3 receives its command with respect to the desired operating position via control lines 10 which are connected to a non-illustrated control or microcomputer system.

Keys 8 and 9 shown in FIG. *2b* are arranged on a control panel or desk and connected to the aforementioned non-illustrated microcomputer system.

Upon the occurrence of soiling of or a deposit of impurities on the plate cylinder 1, one of the keys 9, for example, is actuated. The rotary magnet 3 is excited via the non-illustrated microcomputer system and via the control lines 10 to effect a rotary movement. The cleaning element 4 shown in FIG. 1 is moved, due to the movement of the rotary magnet 3, in the direction toward the plate cylinder 1. The cleaning element 4, at the side thereof formed as the ink doctor blade 6, thus comes into contact with the outer surface of the plate on the plate cylinder 1. Any impurities present on the surface of the plate are thus scraped off by the doctor blade 6. The duration of the scraping or squeegeeing performed by the doctor blade 6 can be determined by providing a fixed period when the key is depressed and released or by so constructing the control system with conventional means so that the squeegeeing or scraping by the doctor blade 6 will continue so long as a servicing personnel keeps the activating key 8 or 9 depressed. After the cleaning has occurred, the rotary magnet 3 returns to its rest position, and contact is broken between the ink doctor blade 6 and the surface of the plate cylinder 1. It is also conceivable to provide an embodiment wherein the cleaning time is individually selectable and applicable, respectively, by means of a light pen.

When impurities are formed on the blanket cylinder 2, the cleaning process occurs in an analog sequence. One of the keys 8 is initially actuated, thereby exciting the rotary magnet 3 into a movement directed towards the blanket cylinder 2. The side of the cleaning element 4, which is formed as an ink doctor blade 5, comes into contact with the blanket cylinder 2, whereby scraping away or squeegeeing the impurity is achieved.

The foregoing description relates to a single cleaning element 4. In accordance with the invention, however, a plurality of such cleaning elements 4 may be arranged adjacent one another. The number of such cleaning elements 4 may be determined in accordance with the need or requirement. The greater the number of such cleaning elements, the smaller is the operating range of the individually cleaning element 4 with respect to the length of the cylinder 1, 2.

In the illustrated embodiment, thirty-two cleaning elements per cylinder are provided, so that thirty-two cleaning zones per cylinder result therefrom. In order that each of the cleaning zones may be separately activated, thirty-two keys with double functions or sixty-four keys with individual functions are provided (FIG. 2). If it is determined that impurities are located, for example, on the plate cylinder 1 in the region of the cleaning zones 3', 5', 8', 11', 32', the keys 8, 9 which are associated with the cleaning zones are actuated, and a simultaneous cleaning is performed thereat.

In an analogous manner, a cleaning of the blanket cylinder 2 may be effected with the keys 8.

The foregoing activation of the cleaning elements by means of the keys 8 and 9 may also be effected by means of other input devices, for example, by means of a light pen 11, as is provided for in the well-known CPC System of Heidelberger Druckmaschinen AG, Heidelberg, Germany. The light pen 11 is connected via a control panel or desk to an ink-zone display 12 (FIG. 2*a*).

Upon the occurrence of an impurity, for example in the region of the cleaning zones 3', 5', 8', the light pen is directed to the ink-zone display 12, and the ink zones 3', 5', 8' are caused to respond. The system is constructed so that, during the cleaning process, it is in the cleaning mode due to which no ink zone adjustment occurs. Moreover, the cleaning elements are actuated during the cleaning mode. The operating range of each cleaning element thus corresponds to a respective ink zone, in the foregoing example.

It is also possible to provide an embodiment of the invention wherein only the plate cylinder 1 or only the blanket cylinder 2 can be cleaned. In such a case, the rotary magnet 3 is actuated for movement in only one direction.

It is conceivable also in a further embodiment to dispense with the rotary magnet and to construct the individual cleaning elements as sliders which then, respectively, operate with reference to an associated cylinder (plate cylinder 1 or blanket cylinder 2) i.e. they have no double effect upon the blanket cylinder 2 or plate cylinder 1. If a simultaneous cleaning of the blanket cylinder 2 and the plate cylinder 1 is to occur, the sliders associated with the blanket cylinder 2 and the plate cylinder 1 are to be simultaneously actuated.

In yet another embodiment of the invention, a motor, such as a transmission motor, for example, may be used instead of a rotary magnet.

Because the possibility of zonewise adjustment of the ink has already been often realized in printing machines (for example, the CPC System of Heidelberger Druckmaschinen AG), yet a further embodiment is provided wherein the keys which are provided for zonewise ink control or regulation are also used for actuating the cleaning elements.

We claim:

1. Device for cleaning selected surface portions of selectively one and both of a plate and a blanket cylinder of an offset printing machine, comprising a plurality of cleaning elements disposed adjacent one another in a direction parallel to respective cylindrical peripheral surfaces of a plate and a blanket cylinder and being mounted so as to be displaceable towards and away from said cylinders, a driving device for selectively positioning at least some of said cleaning elements towards at least one of said cylinders and towards both of said cylinders; and an input and control device for actuating the respective cleaning elements.

2. Device according to claim 1, including a rotary magnet to which each of said cleaning elements is attached, each of said cleaning elements being displaceable along a circular path towards the cylindrical peripheral surface of said at least one cylinder.

3. Device according to claim 1, including a motor operatively connected to each of said cleaning elements for actuating said cleaning elements.

4. Device according to claim 3, wherein said motor is a transmission motor.

5. Device according to claim 1, wherein said input and control device includes means for adjusting ink zones of an inking device having a keyboard by which said cleaning elements are actuatable.

6. Device according to claim 1, wherein said input and control device includes means for adjusting ink zones for an inking device having a light pen by which said cleaning elements are actuatable.

7. Method of operating a device for cleaning selected surface portions of selectively one and both of a plate and a blanket cylinder of an offset printing machine including a device for adjusting ink zones of an inking device having a plurality of cleaning elements disposed adjacent one another in a direction parallel to respective cylindrical peripheral surfaces of a plate and a blanket cylinder and being mounted so as to be displaceable towards and away from said cylinders positioning at least some of the cleaning elements selectively towards at least one of said cylinders and towards both of said cylinders and actuating the respective cleaning elements, by depressing at least one key of a keyboard for a period of time corresponding to the time period during which cleaning is effected by the cleaning device.

8. Method of operating a device for cleaning selected surface portions of selectively one and both of a plate and a blanket cylinder of an offset printing machine including a device for adjusting ink zones of an inking device having plurality of cleaning elements disposed adjacent one another in a direction parallel to respective cylindrical peripheral surfaces of a plate and a blanket cylinder, and being mounted so as to be displaceable towards and away from said cylinders positioning at least some of the cleaning elements selectively towards at least one of said cylinder and towards both of the cylinders, and in accordance with present time limiting data, to perform a cleaning operation within the preset time limit.

9. Method of operating a device for cleaning selected surface portions of at least one of a plate and a blanket cylinder of an offset printing machine including a device for adjusting ink zones of an inking device having a plurality of cleaning elements disposed adjacent one another in a direction parallel to a cylindrical peripheral surface of at least one of a plate and a blanket cylinder, a driving device for positioning each of the cleaning elements towards and away from the at least one cylinder, and an input and control device for actuating the respective cleaning elements by inputting values with a light pen for establishing the cleaning time of a cleaning operation by the cleaning device.

10. Device for simultaneously cleaning selected surface portions of a plate cylinder and a blanket cylinder in an offset printing machine, comprising a plurality of cleaning elements disposed adjacent one another in a direction parallel to a cylindrical peripheral surface of the plate cylinder and the blanket cylinder; a driving device for positioning some of said cleaning elements towards and away from the plate cylinder and for positioning others of said cleaning elements towards and away from said blanket cylinder; and an input and control device for actuating the respective cleaning elements.

11. Device according to claim 11, wherein each of said cleaning elements has two doctor blades, respectively directed towards the plate cylinder and the blanket cylinder.

* * * * *

UNITED STATES PATENT AND TRADEMARK OFFICE

CERTIFICATE OF CORRECTION

PATENT NO. : 5,020,433

DATED : June 4, 1991

INVENTOR(S) : Willi Jeschke, Anton Rodi and Jürgen Reithofer

It is certified that error appears in the above-identified patent and that said Letters Patent is hereby corrected as shown below:

In the Title Page, item (75)

"Inventors: Willi Jeschke, Bad Herrenalb; Anton Rodi, Leimen, both of Fed. Rep. of Germany"

should read

- - Inventors: Willi Jeschke, Bad Herrenalb; Anton Rodi, Leimen; Jürgen Reithofer, Nussloch, all of Fed. Rep. of Germany - - .

Signed and Sealed this

Third Day of November, 1992

*Attest:*

DOUGLAS B. COMER

*Attesting Officer*

*Acting Commissioner of Patents and Trademarks*